US005295467A

United States Patent [19]

Hafner

[11] Patent Number: 5,295,467

[45] Date of Patent: Mar. 22, 1994

[54] FUEL DISTRIBUTOR

[75] Inventor: Udo Hafner, Ludwigsburg, Fed. Rep. of Germany

[73] Assignee: Robert Bosch GmbH, Stuttgart, Fed. Rep. of Germany

[21] Appl. No.: 880,457

[22] Filed: May 8, 1992

[30] Foreign Application Priority Data

May 8, 1991 [DE] Fed. Rep. of Germany ..... 4115039

[51] Int. Cl.[5] ..... F02M 41/00

[52] U.S. Cl. ..... 123/456; 123/468

[58] Field of Search ..... 123/468, 469, 470, 456, 123/451, 516

[56] References Cited

U.S. PATENT DOCUMENTS

| | | | |
|---|---|---|---|
| 2,827,030 | 3/1958 | Strumbos | 123/451 |
| 4,395,988 | 8/1983 | Knapp | 123/469 |
| 4,474,160 | 10/1984 | Gartner | 123/470 |
| 4,570,602 | 2/1986 | Atkins | 123/456 |
| 4,601,275 | 7/1986 | Weinand | 123/456 |
| 4,836,246 | 6/1989 | Lemp . | |
| 4,844,036 | 7/1989 | Bassler et al. . | |
| 4,860,710 | 8/1989 | Hafner et al. . | |
| 4,922,958 | 5/1990 | Lemp | 123/456 |
| 4,955,409 | 9/1990 | Tokuda et al. . | |
| 5,035,221 | 7/1991 | Martin | 123/451 |
| 5,056,489 | 10/1991 | Lorraine | 123/468 |
| 5,076,242 | 12/1991 | Parker | 123/468 |
| 5,143,039 | 9/1992 | Gmelin | 123/456 |

FOREIGN PATENT DOCUMENTS

| | | |
|---|---|---|
| 235394 | 9/1987 | European Pat. Off. . |
| 3228508 | 2/1984 | Fed. Rep. of Germany . |
| 3843097 | 7/1989 | Fed. Rep. of Germany . |
| 3914487 | 11/1990 | Fed. Rep. of Germany . |
| 9003510 | 4/1990 | World Int. Prop. O. . |
| 9100959 | 1/1991 | World Int. Prop. O. . |

*Primary Examiner*—Carl S. Miller

*Attorney, Agent, or Firm*—Edwin E. Greigg; Ronald E. Greigg

[57] ABSTRACT

A known fuel distributor, which has continuous valve receptacle openings for fuel injection valves. The fuel distributor prevents vapor bubbles that cause difficulties in engine starting to form. The novel fuel distributor has a fuel supply line split by a partition into a first conduit and a second conduit; the second conduit serves as a reservoir and communicates both with the first conduit, through a through opening, and with the various valve receptacle openings. In the fuel reservoir, fuel free of vapor bubbles can collect after the shutoff of the hot engine; upon hot starting of the engine, this makes it possible to inject fuel that is free of vapor bubbles and is readily ignitable through the fuel injection valves. The fuel distributor according to the invention is especially well-suited for fuel injection systems of mixture-compressing internal combustion engines with externally supplied ignition.

15 Claims, 5 Drawing Sheets

FUEL DISTRIBUTOR

BACKGROUND OF THE INVENTION

The invention is based on a fuel distributor as defined hereinafter. German Patent Document 37 30 571 A1 has already disclosed a fuel distributor for an internal combustion that supplies fuel to a plurality of fuel injection valves; it has as many through valve receiving openings as there are fuel injection valves, the fuel injection valves being insertable into these openings, and also has a supply line that is open toward the valve receiving openings.

When a hot engine equipped with this kind of fuel distributor is started, the formation of fuel vapor bubbles can cause problems in engine starting if fuel full of vapor bubbles is injected in the first few seconds after starting. The starting problems are due to the pronounced effective leaning down of the fuel-air mixture formed, which makes it unready to ignite.

OBJECT AND SUMMARY OF THE INVENTION

The fuel distributor according to the invention has the advantage over the prior art that even in the first few seconds after hot starting of the engine, the injection of fuel free of vapor bubbles through the fuel injection valve is insured by the formation of an adequate reservoir of fuel free of vapor bubbles. The fuel-air mixture thus formed is readily ignitable. The second conduit serves to increase the volume surrounding the fuel injection valves, such that when the hot engine is turned off an adequate amount of vapor-free and hence liquid fuel can collect; this enables hot starting of the engine and assures the fuel supply until the fuel injection valves have cooled down enough that no vapor bubbles will form in the fresh fuel reaching the fuel injection valve from the first conduit.

The fuel distributor, with the fuel supply line split by a partition into a first conduit and a second conduit, is simple and economical to manufacture.

To additionally increase the volume surrounding the fuel injection valve, it is advantageous if storage volumes are formed, surrounding the fuel injection valves, between the wall of the valve receiving openings and the circumference of a given fuel injection valve.

For simple, economical embodiment of a partition, it is advantageous if a tube that forms the partition between the first and second conduits is disposed in the fuel supply line.

It is advantageous if the outer diameter of the tube is less than the diameter of the inner wall of the fuel supply line. A partition of this kind, embodied by the tube, has a very large surface area, so that the fuel located in the second conduit is especially well cooled by the fuel flowing past it in the first conduit.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
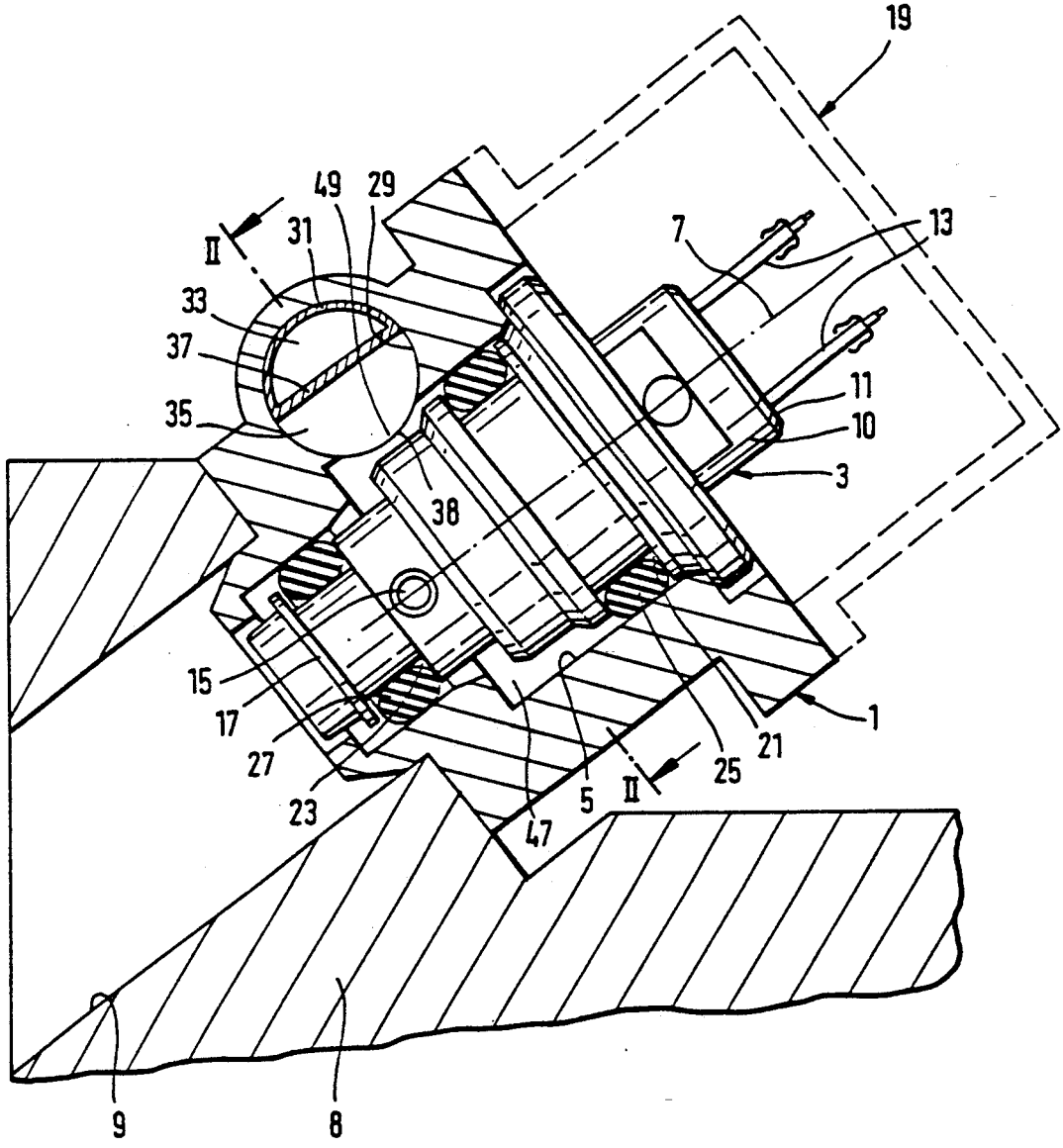
FIG. 1 shows a fuel distributor according to the invention in a first exemplary embodiment.

The fuel distributors for fuel injection systems of mixture-compressing internal combustion engines with externally supplied ignition, shown by way of example in the drawings, are identified by reference numeral 1. The fuel distributor 1, of elongated shape, for instance, serves to supply fuel to at least two fuel injection valves 3; in the first exemplary embodiment of FIGS. 1 and 2, there are four such valves, by way of example. For receiving the fuel injection valves 3, the fuel distributor 1 has a number of stepped valve receptacle openings 5, passing all the way through the fuel distributor 1 along a longitudinal axis 6 of the fuel distributor and corresponding in number to the number of fuel injection valves 3; the fuel injection valves 3 can be inserted into these openings in such a way that the walls of the valve receptacle openings 5 at least partly surround the fuel injection valves 3 in the direction of a longitudinal receptacle axis 7 of each valve receptacle opening 5.

By way of example, the fuel distributor 1 is disposed on an intake tube 8 of an engine in such a way that the fuel injection valves 3 inserted into the fuel distributor 1 discharge the fuel into intake tube conduits 9 of the intake tube 8, for instance immediately in front of inlet valves, not shown, of the engine.

Figure 3:
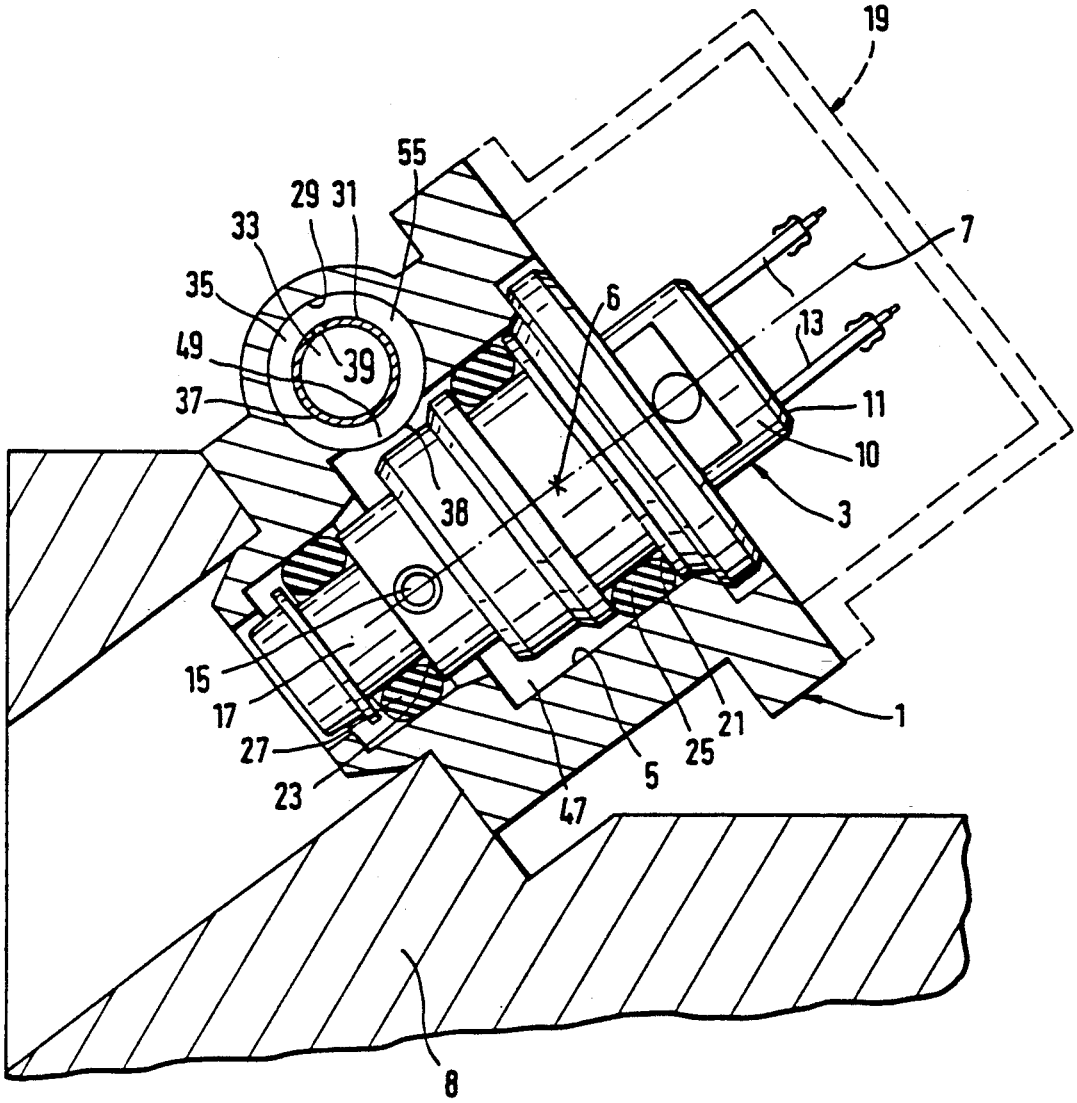
FIG. 3 shows a fuel distributor according to the invention in a second exemplary embodiment.
Figure 5:
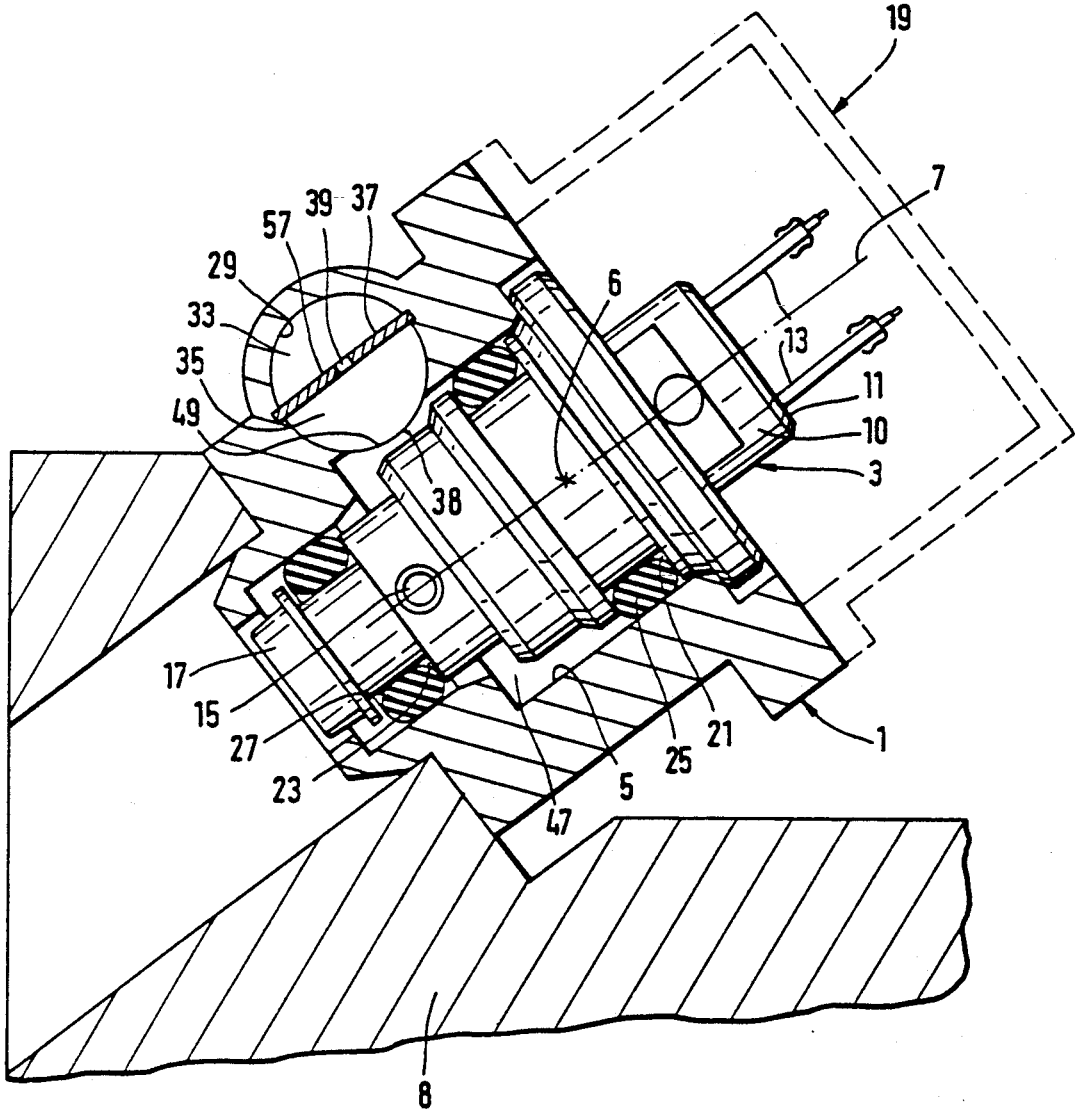
FIG. 5 shows a fuel distributor according to the invention, in a third exemplary embodiment.

The fuel injection valves 3 shown by way of example in FIGS. 1, 3 and 5 have an electrical contact plug 11 on one connection end 10, with electrical contact elements 13, for instance two in number, and fuel delivery openings 15 on their circumference, again for instance two in number. The fuel is discharged from an end 17, remote from the connection end 10, of the applicable fuel injection valve when it is actuated.

For providing electrical contact of the fuel injection valves 3 with their electrical contact elements 13, a known power strip 19 can for instance be used, as shown in dashed lines in FIGS. 1, 3 and 5.

On the circumference of each fuel injection valve 3, above the fuel delivery openings 15, which are embodied at least approximately at the same axial height of the longitudinal receptacle axis 7, toward the connection end 10, is a first annular groove 21, while below the fuel delivery openings 15, toward the valve end 17, there is a second annular groove 23. A first sealing ring 25 is disposed in the first annular groove 21, and a second sealing ring 27 is disposed in the second annular groove 23. The sealing rings 25, 27 provide sealing between the circumference of the fuel injection valve 3 and the wall of the valve receptacle opening 5, preventing the fuel to be delivered to the fuel delivery openings 15 of the fuel injection valve 3 from escaping at an undesired point from the valve receptacle opening 5.

A fuel supply line 29 extending longitudinally of the fuel distributor, parallel to the longitudinal axis 6 thereof, is embodied in the fuel distributor 1 and serves to supply fuel to the fuel injection valves 3; by way of example, it is circular in cross section, and it communicates with the valve receptacle openings 5.

Figure 2:
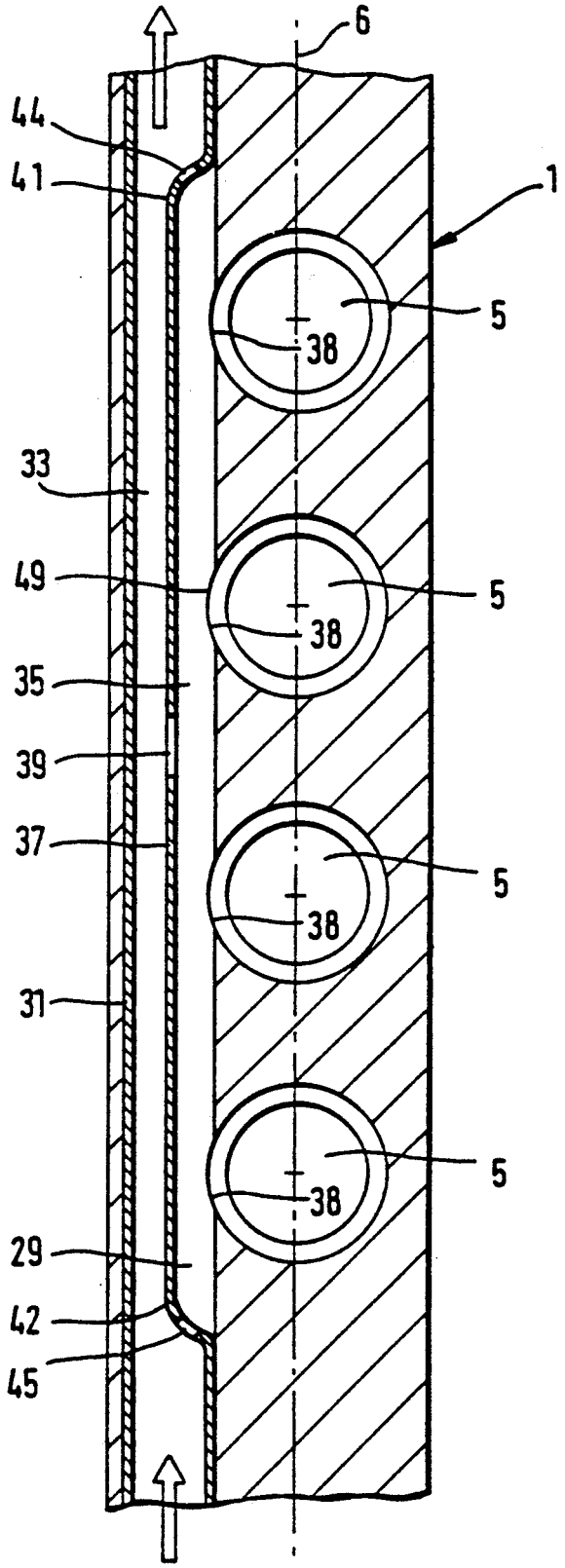
FIG. 2 is a section taken along the line II—II of FIG. 1.

In the first exemplary embodiment shown in FIGS. 1 and 2, where FIG. 2 is a section taken along the line II—II of FIG. 1, a tube 31 with a circumference having approximately the same diameter as the inner wall of the fuel supply line 29 is disposed in the fuel supply line 29. As an example, the tube 31 can be installed in the fuel supply line 29 by being pressed into place, with the tube 31 having a slightly larger diameter than the inner wall of the fuel line 29, so that a firm hold of the tube 31 in the fuel supply line 29 is assured. However, it is also possible for the tube 31, having a somewhat smaller diameter than the wall of the fuel supply line 29, to be pushed into the fuel supply line 29 and joined to the fuel distributor at its ends, for example.

The tube 31 in the first exemplary embodiment rests by its circumference partly on the wall of the fuel supply line 29. In the region of the valve receptacle openings 5, of which there are for instance four, the cross section of the tube 31 is plastically deformed in part by compression, in the direction perpendicular to the longitudinal axis 6 of the distributor, remote from the valve receptacle openings 5. In this way, the fuel supply line 29 is split into a first conduit 33 and a second conduit 35. The first conduit 33 is defined by the inner wall of the tube 31; the second conduit 35 is defined by a part of the outer wall of the tube 31 that is embodied as a partition 37 and deformed in such a way that the partition 37 for instance extends parallel to the longitudinal receptacle axes 7 of the valve receptacle openings 5, and by the inner wall, toward the valve receptacle openings 5, of the fuel supply line 29. The second conduit 35 communicates at a tangent with the various valve receptacle openings 5 by means of overlapping openings 38. In the first exemplary embodiment, the first partition 37 of the fuel supply line 29 extends somewhat past the valve receptacle openings 5 in the direction of the longitudinal distributor axis 6.

The second conduit 35 of the fuel supply line 29 serves to form a fuel reservoir. The first conduit 33 communicates with the second conduit 35 through at least one through opening 39 passing through the partition 37. The main flow of fuel through the fuel distributor 1 scavenges the first conduit 33, in order to cool the fuel injection valves 3 and the fuel distributor 1, and only flows past the second conduit 35, separated from it by the partition 37. Only a small portion of the fuel that scavenges the first conduit 33 gets into the second conduit 35, through the through opening 39, of which for instance there is one, and replaces the fuel discharged from the reservoir by the fuel injection valves 3. The through opening 39 may be located in the middle or at any other point of the partition 37.

Additionally, each of two ends 41 and 42 of the second conduit 35 are provided with a respective vent opening 44 and 45, passing through the partition 37. The vent openings establish communication between the second conduit 35 and the first conduit 33 and serve to ventilate the second conduit 35 acting as a fuel reservoir. Via the vent openings 44 and 45, not only can a change of fuel take place between the first conduit 33 and the second conduit 35, but vapor bubbles can also pass from the second conduit 35 into the first conduit 33.

A reservoir volume 47 surrounding the fuel injection valve 3 is formed in the radial direction between the wall of each valve receptacle opening 5 and the circumference of the applicable fuel injection valve 3; this volume extends in the direction of the longitudinal receptacle axis 7 from the sealing ring 25 to the second sealing ring 27 and communicates with both the second conduit 35 and the fuel delivery opening 15 of the applicable fuel injection valve 3.

The second conduit 35 of the fuel supply line 29, forming the fuel reservoir, and the reservoir volume 47 surrounding each fuel injection valve 3 form a large volume, hereinafter called the thick-juice reservoir 49, in the region of the fuel injection valve 3. "Thick juice" is a term used by those in the art for fuel reduced by its more volatile components, which have escaped in the form of vapor bubbles. Since this thick-juice fuel has a higher boiling point, it has less of a tendency to form vapor bubbles than fuel of normal consistency. This makes it possible for the first time to achieve exact metering of the fuel quantity in liquid form in hot starts, because vapor bubbles can no longer affect the metering.

The function of the thick-juice reservoir 49 is as follows: After a hot engine, equipped with the fuel distributor 1 according to the invention, is shut off, there is a pronounced thermal action at the surface of the fuel injection valve 3 and fuel distributor 1 on the now-motionless fuel in the thick-juice reservoir 49, because of the absence of the cooling action of the air flowing through the engine compartment, the coolant circulating in the engine, and the fresh fuel flowing through the fuel distributor 1 during operation, some of which flows into the fuel reservoir formed by the second conduit 35. As a consequence, the fuel in the thick-juice reservoir 49 is heated, and the more volatile fuel ingredients evaporate. This vapor bubble formation is further reinforced by the slowly dropping fuel pressure in the first conduit 33, and thus in the thick-juice reservior 49 as well, that follows the shutoff of the engine. The vapor bubbles collect at the partition 37, and the next time the engine is started, if not before, they pass out of the second conduit 35 of the fuel distributor line 29 into the first conduit 33 via the vent openings 44, 45 and the through openings 39. Sometime after the shutoff of the hot engine, all the more volatile components of the fuel inside the thick-juice reservoir 49 will have evaporated; what remains is the thick juice. If a hot start of the engine is now done, then for the first few seconds after starting, it is precisely this liquid thick juice that is injected through the fuel injection valve 3. This assures the readiness of the prepared fuel-air mixture to ignite from the very beginning. Cool fuel pumped by a fuel pump, not shown, increasingly reaches the fuel injection valves 3, through the through opening 39 formed between the first conduit 33 and the second conduit 35 in the partition 37. A suitable transition from pumping thick juice to pumping cool fuel can be attained by suitably selecting the size of the thick-juice reservoir 49, or in other words of the second conduit 35 and reservoir volume 47.

Figure 4:
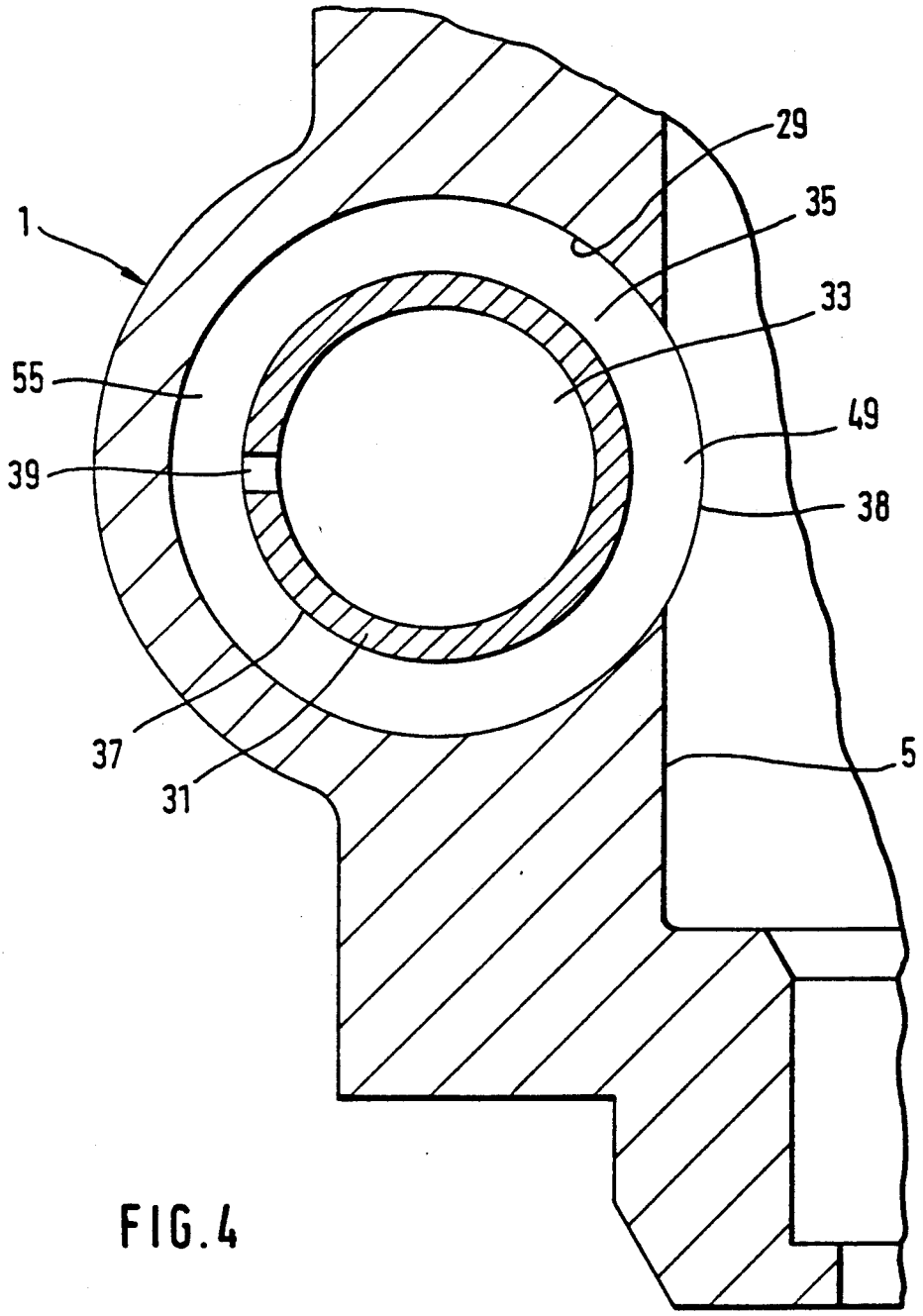
FIG. 4 is a detail, on a larger scale, of the fuel distributor shown in FIG. 3.

A second exemplary embodiment of the invention is shown in FIGS. 3 and 4; FIG. 4 shows a highly enlarged detail of the fuel distributor 1 shown in FIG. 3. Elements that are the same and function the same are identified by the same reference numerals as in FIGS. 1 and 2.

In the fuel distributor 1, a fuel supply line 29 is formed, extending longitudinally of the fuel distributor, parallel to the longitudinal axis 6 of the distributor. This line serves to supply fuel to the fuel injection valves 3, has a circular cross section, for example, and communicates with the valve receptacle openings 5 by means of the overlapping openings 38. A tube 31 is disposed in the fuel supply line 29 and extends concentrically to the inner wall of the fuel supply line 29, for instance, and its outer diameter is smaller than the diameter of the inner wall of the fuel supply line 29. As a result, an annular gap 55 is formed between the circumference of the tube 31 and the inner wall of the fuel supply line 29. The wall of the tube 31 acting as the partition 37 splits the fuel supply line 29 into the first conduit 33, enclosed inside the tube 31 by the wall of the tube 31, and the second conduit 35 outside the tube 31, formed by the annular gap 55; the two conduits extend parallel to the longitudinal distributor axis 6.

However, it is also possible for the tube 31 to be eccentrically disposed in the fuel supply line 29.

The second conduit 35 communicates at a tangent with the various valve receptacle openings 5 and the reservoir volume 47 defined radially by the circumference of the fuel injection valve 3 and the applicable wall of the valve receptacle opening 5. The second conduit 35 serves to form a fuel reservoir. At least one through opening 39, of circular or slit-like shape, for example, passes through the wall of the tube 31 serving as a partition 37 between the two conduits 33, 35, the through opening connecting the first conduit 33 to the second conduit 35.

To cool the fuel injection valves 3 in the fuel distributor 1, the main flow of fuel that scavenges the fuel distributor 1 scavenges the first conduit 33, and only flows past the second conduit 35, separated from it by the partition 37. Only a small portion of the fuel that scavenges the first conduit 33, this portion being equivalent to the fuel quantity injection through the fuel injection valve 3, flows into the second conduit 35 through the for instance single through opening 39 and in this way replaces the fuel discharged from this fuel reservoir.

The second conduit 35 that serves as the fuel reservoir and the single reservoir volume 47 that surrounds the applicable fuel injection valve 3 together form the thick-juice vapor-free or in other words liquid fuel can collect after the shutoff of the hot engine equipped with the fuel distributor 1 according to the invention, thus enabling problem-free hot starting of the engine.

The annular fuel reservoir of the thick-juice volume 49, formed around the tube 31 acting as a partition 37, is cooled especially well by the fuel that scavenges the first conduit 33 of the fuel distributor 1, because of the large surface area of the tube 31, which for instance is concentric with the fuel supply line 29.

A third exemplary embodiment of the invention is shown in FIG. 5. Elements that are the same and function the same are identified by the same reference numerals in FIGS. 1–4. Extending longitudinally of the fuel distributor 1, parallel to the longitudinal axis 6, a fuel supply line 29 is formed in the fuel distributor 1, serving to supply fuel to the fuel injection valves 3; it has a circular cross section, for instance, and communicates with the valve receptacle openings 5 by means of overlapping openings 38. A strip 57 that forms the partition 37 is disposed in the fuel supply line 29, extending parallel to the longitudinal axis 6 of the fuel distributor 1. The strip 57 splits the fuel supply line 29 into a first conduit 33, remote from the valve receptacle openings 5, and a second conduit 35 that communicates at a tangent with the various valve receptacle openings 5 and for instance extends parallel to the longitudinal axes 7 of the valve receptacle openings 5. The second conduit 35 serves to form a fuel reservoir and communicates with the reservoir volumes 47 that surround the fuel injection valves 3 and together with the second conduit 35 form the thick-juice reservoir 49. A single through opening 39, for instance, is formed in the partition 37 and connects the first conduit 33 to the second conduit 35. In this way, cool fuel flows from the first conduit 33 into the second conduit 35 and replaces the fuel discharged from this fuel reservoir through the fuel injection valves 3.

The fuel distributor according to the invention can be embodied by metal or plastic injection molding, for instance, or by forging a metal, such as aluminum. The tube 31 or strip 57 should be placed in the mold prior to the injection molding, for example.

Because of the formation of a fuel reservoir containing fuel free of vapor bubbles, the use of a fuel distributor 1 according to the invention in an internal combustion engine makes it possible for fuel that is free of vapor bubbles and hence ignites readily, to be injected through the fuel injection valves in the first few seconds after hot starting of the engine, and thus enables reliable engine starting and stable engine operation after starting.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel distributor for fuel injection systems of internal combustion engines for supplying fuel to at least two fuel injection valves, having a number of stepped valve receptacle openings, corresponding to the number of fuel injection valves and passing through the fuel distributor, into which openings the fuel injection valves can be inserted such that the stepped valve receptacle openings at least partially surround the fuel injection valves, and having a fuel supply line that communicates with the valve receptacle openings, a tube 31 is disposed in the fuel supply line (29) which forms a partition (37) that divides the fuel supply line into a first conduit (33) and a second conduit (35), the first conduit (33) has fuel flowing through it, and the second conduit (35), forms a fuel reservoir which communicates with the first conduit (33) through at least one through opening (39) that passes through the partition (37) and which communicates with the valve receptacle openings (5).

2. A fuel distributor as defined by claim 1, which includes a reservoir volume (47) surrounding each of the fuel injection valves, the reservoir volume (47) is formed between the wall of the valve receptacle opening (5) and the circumference of the applicable fuel injection valve (3).

3. A fuel distributor for fuel injection systems of internal combustion engines for supplying fuel to at least two fuel injection valves, having a number of stepped valve receptacle openings, corresponding to the number of fuel injection valves and passing through the fuel distributor, into which openings the fuel injection valves can be inserted such that the valve receptacle openings at least partially surround the fuel injection valves, and having a fuel supply line that communicates with the valve receptacle openings, the fuel supply line (29) is divided by a partition (37) into a first conduit (33) and a second conduit (35), the first conduit (33) has fuel flowing through it, and the second conduit (35), forms a fuel reservoir which communicates with the first conduit (33) through at least one through opening (39) that passes through the partition (37) and which communicates with the valve receptacle openings (5), and said first conduit 33 communicates with said valve receptacle openings (5) only through said at least one opening (39) in said partition and through said second conduit (35).

4. A fuel distributor as defined by claim 3, which includes a reservoir volume (47) surrounding each of the fuel injection valves, the reservoir volume (47) is formed between the wall of the valve receptacle opening (5) and the circumference of the applicable fuel injection valve (3).

5. A fuel distributor as defined by claim 1, in which the tube (31) is deformed in a region of the valve receptacle openings (5) to form the two conduits (33, 35).

6. A fuel distributor as defined by claim 2, in which the tube (31) is deformed in a region of the valve receptacle openings (5) to form the two conduits (33, 35).

7. A fuel distributor as defined by claim 1, in which the outer diameter of the tube (31) is smaller than the diameter of the inner wall of the fuel supply line (29).

8. A fuel distributor as defined by claim 2, in which the outer diameter of the tube (31) is smaller than the diameter of the inner wall of the fuel supply line (29).

9. A fuel distributor as defined by claim 7, in which the tube (31) is disposed concentrically in the fuel supply line (29).

10. A fuel distributor as defined by claim 8, in which the tube (31) is disposed concentrically in the fuel supply line (29).

11. A fuel distributor as defined by claim 7, in which the tube (31) is disposed eccentrically in the fuel supply line (29).

12. A fuel distributor as defined by claim 8, in which the tube (31) is disposed eccentrically in the fuel supply line (29).

13. A fuel distributor as defined by claim 3, in which the partition (37) is formed by a linear strip (57) disposed in the fuel supply line (29).

14. A fuel distributor as defined by claim 4, in which the partition (37) is formed by a linear strip (57) disposed in the fuel supply line (29).

15. A fuel distributor as defined by claim 3, in which at least one vent opening (44, 45) is formed on each of the two ends (41, 42) of the second conduit (35), the vent opening passing through the partition (37) and connecting the second conduit (35) to the first conduit (33).

* * * * *